US009845936B1

(12) United States Patent
Sayers et al.

(10) Patent No.: US 9,845,936 B1
(45) Date of Patent: Dec. 19, 2017

(54) LIGHT SHIELD WITH DETACHABLE PANELS FOR CONTROLLING LIGHT DISTRIBUTION

(71) Applicants: Wilston Nigel Christopher Sayers, Atlanta, GA (US); Reed Alan Bradford, Peachtree City, GA (US); Khurram Z. Moghal, Senoia, GA (US)

(72) Inventors: Wilston Nigel Christopher Sayers, Atlanta, GA (US); Reed Alan Bradford, Peachtree City, GA (US); Khurram Z. Moghal, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 126 days.

(21) Appl. No.: 14/930,350

(22) Filed: Nov. 2, 2015

Related U.S. Application Data

(60) Provisional application No. 62/074,214, filed on Nov. 3, 2014.

(51) Int. Cl.
*F21V 11/00* (2015.01)
*F21V 1/00* (2006.01)

(52) U.S. Cl.
CPC ..... *F21V 11/00* (2013.01); *F21V 1/00* (2013.01)

(58) Field of Classification Search
CPC ... F21V 11/00; F21V 1/06; F21V 1/08; F21V 1/04; F21V 1/00
See application file for complete search history.

(56) References Cited

U.S. PATENT DOCUMENTS

| | | | | |
|---|---|---|---|---|
| 3,016,997 | A * | 1/1962 | Price | E04B 9/345 362/317 |
| 3,618,243 | A * | 11/1971 | Bauder | F21S 8/00 40/554 |
| 4,616,293 | A * | 10/1986 | Baliozian | F21V 7/10 362/16 |
| 6,152,579 | A * | 11/2000 | Reed | F21V 7/10 362/297 |
| 7,152,992 | B1 * | 12/2006 | Monroe | F21V 21/02 362/147 |
| 7,264,380 | B1 * | 9/2007 | Monroe | F21V 11/16 362/352 |
| 2015/0300605 | A1 * | 10/2015 | Clark | F21V 1/22 362/367 |

* cited by examiner

*Primary Examiner* — Robert May
(74) *Attorney, Agent, or Firm* — King & Spalding LLP

(57) ABSTRACT

A light shield includes a main portion and an overlap portion that is substantially perpendicular to the main portion. The main portion includes a first scored area and a base platform disposed below the first scored area. The first scored area includes a plurality of score lines that define one or more detachable panels. The overlap portion includes a second scored area and another base platform. The second scored area includes another plurality of score lines that define one or more detachable overlap panels. Further, the light shield includes a flange that extends substantially perpendicular to and along a length of a base platform of the light shield's main portion. A first interlocking arm extends from a first end of the flange and a second interlocking arm extends from a second end of the flange that is opposite to the first end.

18 Claims, 6 Drawing Sheets

LIGHT SHIELD WITH DETACHABLE PANELS FOR CONTROLLING LIGHT DISTRIBUTION

CROSS REFERENCE TO RELATED APPLICATIONS

This non-provisional patent application claims priority under 35 U.S.C. §119 to U.S. Provisional Patent Application No. 62/074,214, titled Light Shield with Detachable Panels, filed on Nov. 3, 2014, which is hereby fully incorporated herein by reference.

FIELD OF INVENTION

Embodiments of the invention relate generally to lighting, and more particularly to a light shield with detachable panels.

BACKGROUND

Luminaires are evolving from having a single light source, such as a bulb, to having an array of light sources, such as an array of light emitting diodes (LEDs) distributed over a wider area to achieve a wider distribution of light. While the wider distribution of light offers a variety of benefits, in some scenarios and circumstances it can pose challenges. For example, a luminaire that is set up to light a user's premise and property (residence) may emit light to a neighboring property due to the wider distribution of light. Similarly, some neighborhoods may have light distribution restrictions for various reasons, such as aesthetics, property value, and so on. Such, constraints may require the light distribution from a luminaire to be controlled such that the light is restricted to specific areas while being kept out of other areas.

Typically, to control the light distribution, a conventional light shield, such as the one shown in FIG. 1 is used with the luminaire. The conventional light shield 102 illustrated in FIG. 1 includes a metal or plastic sheet. Once installed, the conventional light shield 102 is fixed and is not adjustable, thereby greatly reducing flexibility in controlling the light distribution from the luminaire. In other words, the conventional light shield 102 provides only one light restriction pattern. For a different light restriction pattern, another conventional light shield that is shaped differently may be required. That is, each desired light restriction pattern may require a respective different light shield resulting in a myriad of different light shields to cover all desired light restriction patterns which is an inefficient and brute force solution.

Further, conventional light shields 102 add more weight to the luminaire causing undesirable wind load and stress on the mounting post 108. Furthermore, as illustrated in FIG. 1, conventional light sheets 102 are configured to be coupled to a housing 106 of the luminaire 104 which limits the precision with which emitted light can be controlled as compared to a light shield that is coupled closer to the light source of the luminaire 104. For example, as illustrated in the light shield arrangement of FIG. 2, individual light shields 206 are disposed adjacent to the light sources. However, in the arrangement shown in FIG. 2, each light source is coupled to their respective light shield, thus requiring numerous light shields in a single luminaire.

Accordingly, in light of the above discussion, there is a need for a light shield that overcomes the above-mentioned shortcomings.

SUMMARY

In one aspect, the present disclosure can relate to a light shield. The light shield includes a first broad surface having a first plurality of score lines and a second broad surface having a second plurality of score lines. The first broad surface is opposite the second broad surface. Further, the light shield includes a flange that extends substantially perpendicular to and along a length of a base platform of the light shield. The base platform is located at a bottom portion of the light shield and below the broad surfaces. Furthermore, the light shield includes a first interlocking arm extending from a first end of the flange, and a second interlocking arm extending from a second end of the flange that is opposite to the first end of the flange.

In another aspect, the present disclosure can relate to another light shield. The light shield includes a first main portion. The first main portion includes a first scored area that has a plurality of score lines that define one or more detachable panels. Further, the light shield includes a second overlap portion that is substantially perpendicular to and extends away from an edge of the first main portion. The second overlap portion includes a second scored area that has another plurality of score lines that define one or more detachable overlap panels. Furthermore, the light shield includes a flange disposed adjacent a bottom end of the light shield and extending substantially perpendicular to and along a length of the first main portion. The flange includes a first interlocking arm extending beyond the length of first main portion from a first end of the flange. Further the flange includes a second interlocking arm extending beyond the length of the first main portion from a second end of the flange that is opposite to the first end of the flange. The second interlocking arm extends in a direction opposite to the direction of the first interlocking arm.

In yet another aspect, the present disclosure can relate to a light shield that includes a light shield body. The light shield body includes a detachable panel area having one or more detachable panels, and a base platform disposed adjacent to the detachable panel area. Further, the light shield body includes a flange extending from a bottom portion of the base platform at an angle with respect to the base platform and the detachable panel area of the light shield body. Furthermore the light shield body includes a first interlocking arm extending from a first lateral end of the flange in a first direction of a longitudinal length of the flange, and a second interlocking arm extending from a second lateral end of the flange that is opposite to the first end of the flange in a second direction of the longitudinal length of the flange. The first direction and the second direction are opposite to each other.

These and other aspects, objects, features, and embodiments will be apparent from the following description and the appended claims.

BRIEF DESCRIPTION OF THE FIGURES

Embodiments are illustrated by way of example and not limitation in the figures of the accompanying drawings, in which.

Figure 1:
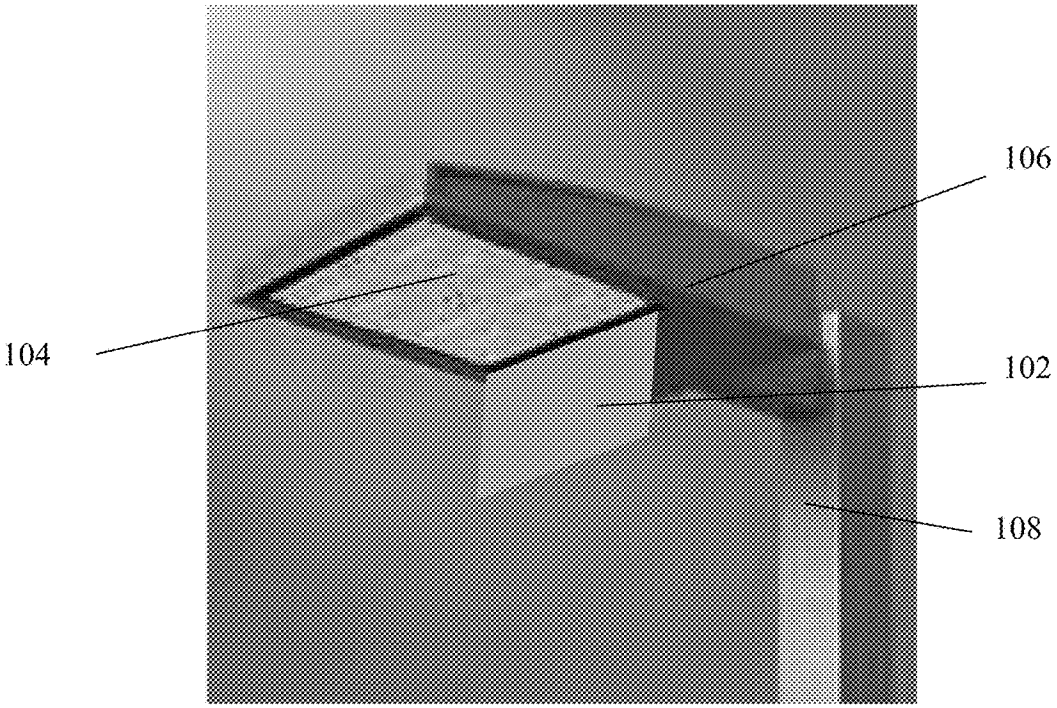
FIG. 1 (Prior Art)
FIG. 1 illustrates a conventional light shield, in accordance with an example prior art embodiment.

Many aspects of the invention can be better understood with reference to the above drawings. The elements and features in the drawings are not to scale; emphasis is instead being placed upon clearly illustrating the principles of example embodiments of the present invention. Moreover, certain dimensions may be exaggerated to help visually convey such principles. In the drawings, reference numerals designate like or corresponding, but not necessarily identical, elements throughout the several views. Other features of the present embodiments will be apparent from the description that follows.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an example light shield having detachable panels and capable of being coupled to a luminaire to control a light distribution from the luminaire. In particular, once the light shield is coupled to a luminaire, one or more of the detachable panels may be detached to allow an adjustment of the light distribution from a luminaire. Further, the light shield may be arrayed or interlocked with one or more other light shields on a periphery of the luminaire to provide an additional degree of control of the light distribution from the luminaire.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 3:
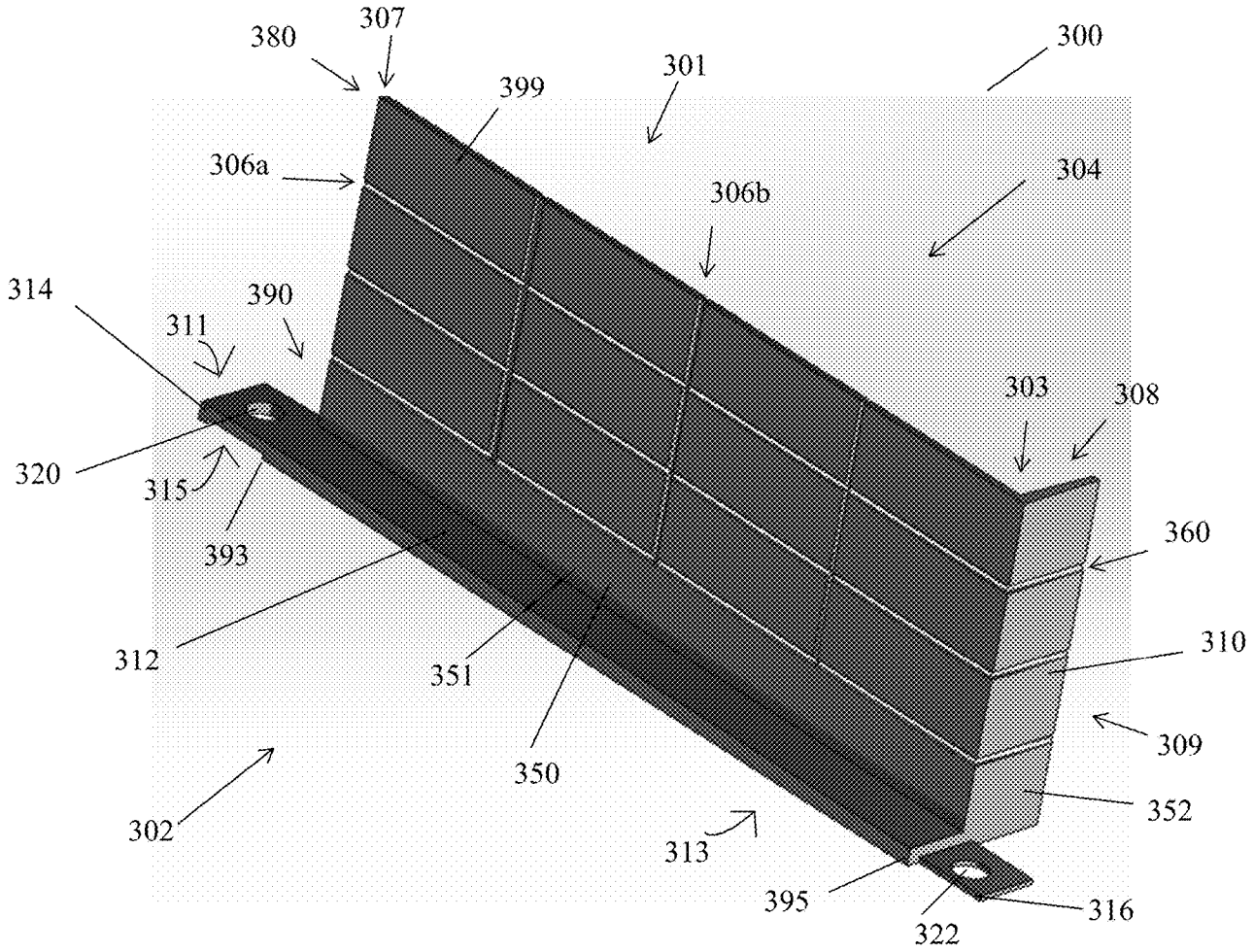
FIG. 3 illustrates the light shield with detachable panels, in accordance with example embodiments of the present disclosure.
Figure 4:
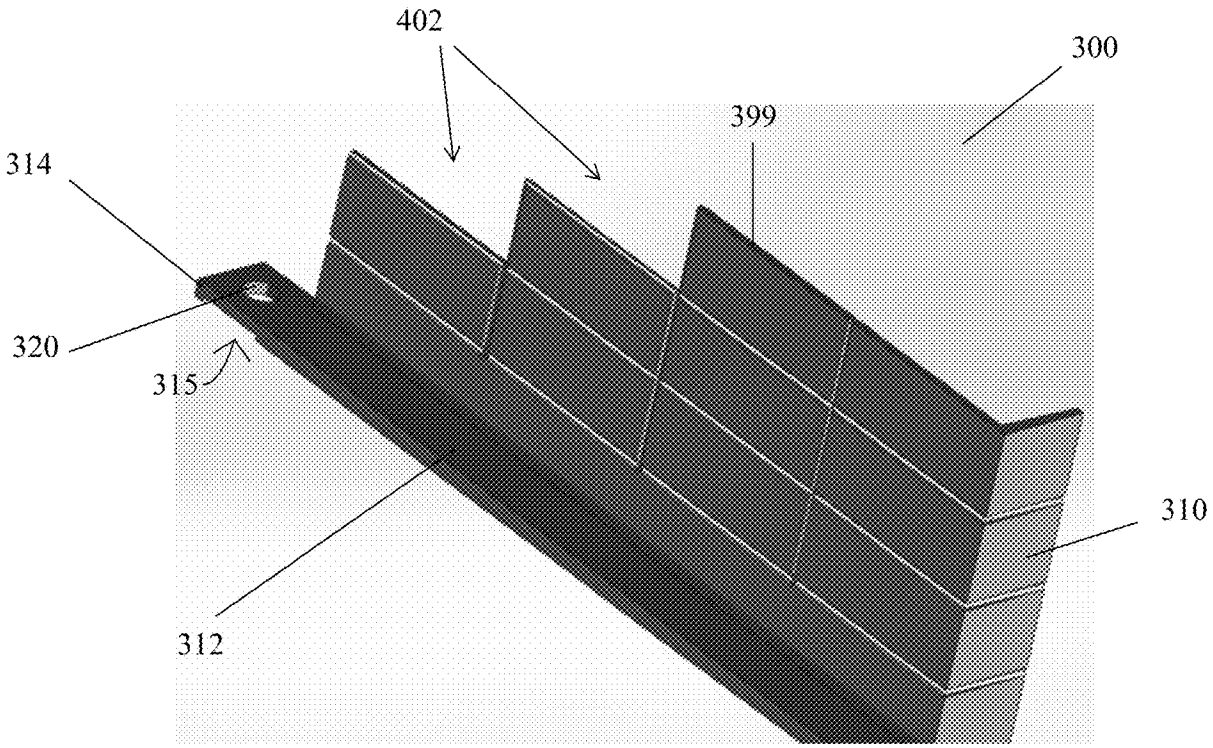
FIG. 4 illustrates the light shield of FIG. 3 with one or more panels of the light shield detached in order to control light distribution, in accordance with example embodiments of the present disclosure.
Figure 5:
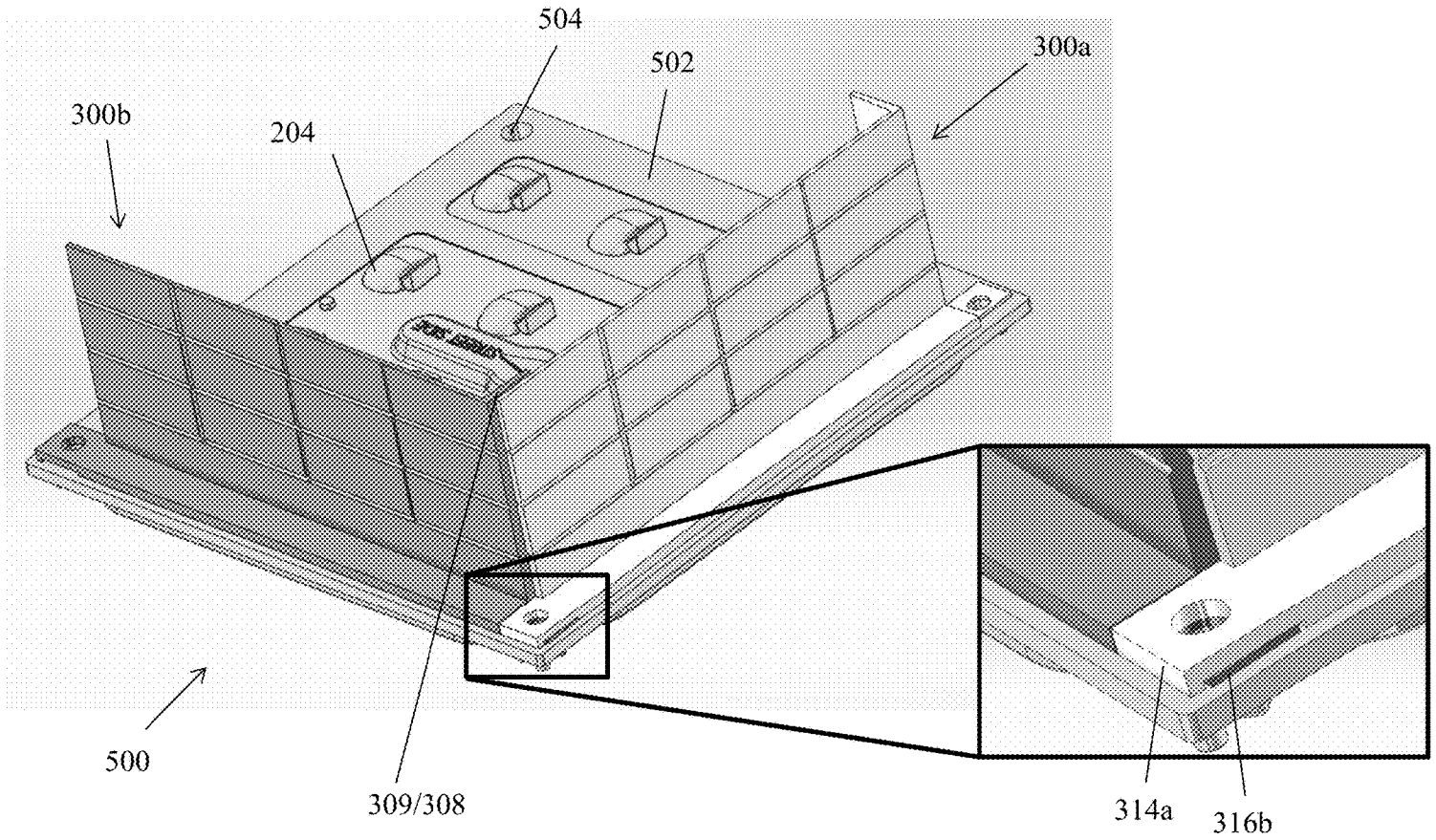
FIG. 5 illustrates an interlocked light shield structure formed by interlocking two or more light shields, in accordance with example embodiments of the present disclosure.

FIG. 3 illustrates the light shield 300 with detachable panels, in accordance with example embodiments of the present disclosure, FIG. 4 illustrates the light shield 300 of FIG. 3 with one or more panels detached in order to control light distribution, in accordance with example embodiments of the present disclosure, and FIG. 5 illustrates an interlocked light shield structure formed by interlocking two or more light shields, in accordance with example embodiments of the present disclosure. Referring to FIGS. 3-5, the light shield 300 includes a shield body 301 that is made of plastic, metal, or any other suitable material. The shield body 301 includes a first broad surface 302, a second broad surface 304 (not shown) that is opposite the first broad surface 302. The first and second broad surfaces (302, 304) are bound by a first lateral edge 303, a second lateral edge 307, a first longitudinal edge 380, and a second longitudinal edge (not shown) that is opposite to the first longitudinal edge 380. Once installed, the second broad surface 304 may face the one or more light sources 204 of the luminaire, while the first broad surface 302 may face away from the light sources 204 in the direction of an external environment, as illustrated in FIG. 5.

In one example embodiment, the second broad surface 304 may have or may be coated with a dark color to absorb the light emitted from the light source 204. In another example embodiment, the second broad surface 304 may have a reflective coating to reflect light away from the light shield 300. That is, the reflective coating would increase an amount of light being directed away from an area where light is being restricted by the light shield 300. In yet another example embodiment, the second broad surface 304 may be coated with material that would provide a mirror-like finish. One of ordinary skill in the art can understand and appreciate that a coating applied of the first broad surface 302 and/or the second broad surface 304 can be adapted and changed to achieve a variety of desired light distributions.

As shown in FIG. 3, the first broad surface 302 may include a first plurality of score lines, such as score lines 306*a* and 306*b* that run in a longitudinal and a latitudinal direction along the first broad surface 302 forming a grid pattern. Although not shown in FIG. 3, one of ordinary skill in the art can understand and appreciate the second broad surface 304 can include a second plurality of score lines that are similar to and aligned with the first plurality of score lines. Further, one of ordinary skill in the art can understand and appreciate that the grid pattern formed by the plurality of score lines (shown in FIGS. 3-5) is only an example pattern, and is not restrictive. That is, the plurality of score lines may run in any direction along the first and/or second broad surfaces and form any other appropriate geometric or non-geometric patterns without departing from a broader scope of this disclosure. For example, the score lines may run only in one direction without crossing each other, i.e., either in a longitudinal direction or in a latitudinal direction along the first and/or second broad surface. Alternatively, in another example, the score lines may form circular patterns, hexagonal patterns, etc.

As illustrated in FIG. 3, the first plurality of score lines (306*a*, 306*b*) and the second plurality of score lines that are aligned with each other may define one or more panels 399. That is, the score lines define a boundary of each panel 399, and allow the panel 399 to be detached along a perimeter (boundary) of the panel 399 defined by the score lines (306*a*, 306*b*), as illustrated in FIG. 4. In other words, a user can detach each panel along the score lines that define a boundary of the respective panel by manually applying pressure. One of ordinary skill in the art can understand and appreciate that in an alternate embodiment the score lines can be replaced by other mechanisms such as tabs that permit the panels to be detached from the shield body 301 of the shield 300.

As illustrated in FIG. 4, one or more panels 399 may be detached from the light shield 300 to control a distribution of the light from the luminaire. For example, once a panel is detached, the light shield 300 allows light from a luminaire to pass through the opening 402 formed by detaching the panel 399 from the light shield 300 as shown in FIG. 4. One of ordinary skill in the art can understand and appreciate that when more panels 399 are detached from the light shield 300, the light from the luminaire gets distributed to a wider area than when all the panels of the light shield 300 are intact. That is, once light is emitted from the luminaire, a direction and intensity of the light distribution from the luminaire may be controlled using the panels 399 (and/or overlap panel 310 described below in the following paragraphs) that can be detached from the light shield 300. Accordingly, the panels 399 provide a user with finer control of the light distribution from a luminaire. Even though FIG. 4 shows panels detached from one corner of the light shield 300, one of ordinary skill in the art can understand and appreciate that a variety of light distributions can be achieved by detaching various panels from any portion of the light shield 300. For example, a panel could be removed from the center of the light shield 300 without removing any other surrounding panels to provide a "spot light" effect with a portion of the light passing through the center of the shield where the panel has been removed.

Referring back to FIG. 3, in addition to the first and second broad surfaces 302, 304, the light shield 300 includes a first overlap surface 309 and a second overlap surface 308. Alternatively, in some example embodiments, the light shield 300 may not include the overlap portion with the surfaces 308 and 309. In one example embodiment, the first overlap surface 309 and the second overlap surface 308 may extend from one of the lateral edges of the shield body, e.g., lateral edge 303, and may be substantially perpendicular to the shield body 301 in a direction facing the light source, as illustrated in FIG. 3. In another example embodiment, the first overlap surface 309 and the second overlap surface 308 may extend from one of the lateral edges of the shield body, e.g., lateral edge 303, and may be aligned at an angle other than 90 degrees from the shield body 301. Also shown in FIG. 3 is a third plurality of score lines 360 on the first overlap surface 309. One of ordinary skill in the art can understand and appreciate that the second overlap surface 308 may include a fourth plurality of score lines that are similar to and aligned with the third plurality of score lines 360. The third and fourth plurality of score lines along with the lateral edge, e.g., edge 303 may define one or more overlap panels 310. Similar to the panels 399 described above, the overlap panels 310 may be detached along their respective score lines (e.g., score lines 360 and score lines along the lateral edge 303) to provide control of the light distribution from a luminaire. As described above, one of ordinary skill in the art can understand and appreciate that score lines may be provided along the lateral edge 303 of the shield body 301 such that the overlap panel 310 can be broken off and separated from the panels 399 on the broad surfaces (302, 304).

The overlap panels 310 and the overlap surfaces 308, 309 provide better control of the light distribution from the luminaire around the edges and corners of the light shield 300. The advantages of the overlap panels 310 and/or the overlap surfaces 308, 309 are more apparent in FIG. 5. As illustrated in FIG. 5, the overlap panels 310 and/or overlap surfaces 308, 309 prevent light from escaping through the corners of a light shield structure 500 formed by interlocking two or more light shields 300*a* and 300*b*. The overlap surfaces 308, 309 and the broad surfaces 302, 304 can be formed as a single structure. That is, the overlap surfaces 308, 309 and the first and second broad surfaces 302, 304 can be integral to the shield body 301. In said embodiment, the shield body 301 may be a single L-shaped structure where the score lines along the overlap surfaces may be extensions of the score lines along the broad surfaces. For example, score lines 360 on the first overlap surface 308 may be an extension of score lines 306*a* of the first broad surface 302. In another embodiment, the overlap surfaces (308, 309) and the broad surfaces (302, 304) may be formed as separate members that may be coupled together at the time of installation to form the L-shaped light shield 300.

In one example embodiment, the integral L-shaped light shield 300 may include a first main portion and a second overlap portion that is substantially perpendicular to the first main portion. The second overlap portion extends from a lateral edge (e.g., edge 303 and/or 307) of the first main portion. In some embodiments, the light shield 300 may have a third overlap portion that extends from an opposite lateral edge of the first main portion, thus forming a U-shaped light shield (not shown in Figures). The first main portion includes the first broad surface 302 and the second broad surface 304, and the second overlap portion may include the first overlap surface 308 and the second overlap surface 309. Further, the first main portion and the second overlap portion may include a base platform that may or may not include score lines.

In an embodiment where the base platform does not include score lines, the first main portion and the second main portion may be described as including (i) a scored portion that has the plurality of score lines and (ii) a base platform that does not include score lines and located below the scored portion at a bottom portion of the light shied body. The base platform will be described in greater detail in the following paragraphs.

In addition to the overlap surfaces (308, 309), overlap panels 310, broad surfaces (302, 304), and panels 399, as illustrated in FIG. 3, the light shield 300 includes a base platform 350 disposed at and/or adjacent a bottom end 390 of the shield body 301. The base platform 350 includes a first portion 351 and a second portion 352 that extends substantially perpendicular to or at an angle from a lateral end of the first portion 351 in a direction of the overlap panel surfaces (308,309). The first portion 351 is aligned to be substantially flush with the broad surfaces (302, 304), while the second portion 352 is aligned to be substantially flush with the overlap surfaces (308, 309). The first and second plurality of score lines, e.g., 306*a*, may distinguish the panels 399 from the first portion 351 of the base platform 350, and the third and fourth plurality of score lines 360 may distinguish overlap panels 310 from the second portion 352 of the base platform 350, as illustrated in FIG. 3. Further, as described above, the base platform 350 may or may not have score lines.

In addition to the first and second portions (351, 352), the base platform 350 includes a flange 312 that extends substantially perpendicularly to first portion 351 along a length of the base platform 350 in a direction opposite to or away from the overlap panel surfaces (308, 309) and/or the light source (when the light shield 300 is in a luminaire. The flange 312 may have a top surface 311, a bottom surface 313, a first end 393, and a second end 395 that is opposite to the first end 393. Although the embodiment in FIG. 3 shows a 90 degree angle between the flange 312 and the base platform 350, in alternate embodiments the flange 312 may extend from the base platform 350 at an angle greater or less than 90 degrees so that the shield 300 is either angled inward toward the light source or outward away from the light source.

A first interlocking arm 314 extends from the first end 393 of the flange 312 and may be flush with the top surface 311 of the flange 312. In particular, the first interlocking arm 314 extends from the first end 393 along a plane than passes through the length of the flange 312 and is substantially perpendicular to the broad surfaces (302, 304) of the shield body 301. Further, as illustrated in FIG. 3, the first interlocking arm 314 includes a recess 315 and an aperture 320.

A second interlocking arm 316 extends from the second end 395 of the flange 312. In particular, the second interlocking arm 316 is flush with the bottom surface 313 of the flange 312 and is offset from top surface 311 of the flange 312. As shown in FIG. 3, the second interlocking arm 316 extends in a direction opposite to the direction of the first interlocking arm 314 and includes an aperture 322.

The first and the second interlocking arms (314, 316) of the light shield 300 may be configured to couple the light shield 300 with one or more other light shields by interlocking the light shield 300 with the one or more other light shields as illustrated in FIG. 5. In particular, the recess 315 of the light shield's first interlocking arm 314 may be configured to receive and fit a second interlocking arm of another light shield. In other words, the first interlocking arm 314 of the light shield 300 may be configured to mate with a second interlocking arm of another light shield, and the second interlocking arm 316 of the light shield 300 may be configured to mate with a first interlocking arm of another light shield.

The interlocking of one or more light shields to form an interlocked light shield structure 500 for providing an additional degree of control of the light distributed from the luminaire is better illustrated in the example embodiment of FIG. 5. In particular, FIG. 5 illustrates a first light shield 300*a*, a second light shield 300*b*, a first interlocking arm 314*a* of the first light shield 300*a*, a second interlocking arm 316*b* of the second light shield 300*b*, one or more light sources 204, a substrate 502 comprising the light sources, and one or more coupling holes 504 on the substrate.

Figure 2:
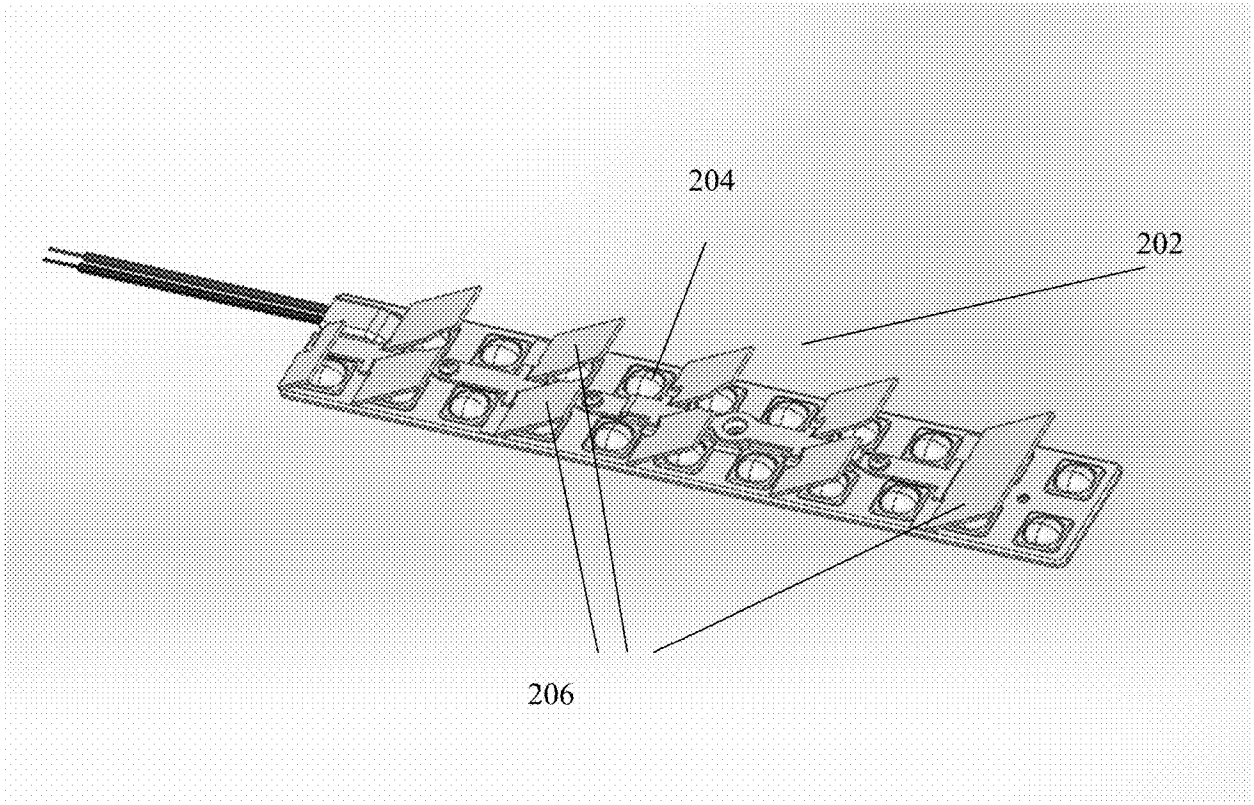
FIG. 2 (Prior Art)
FIG. 2 illustrates another arrangement of conventional light shields, in accordance with an example prior art embodiment.

The substrate 502 as illustrated in FIG. 5 may comprise a circuit board on which the light sources 204 are disposed and a light transmitting cover placed over the circuit board and light sources 204. In one example, the light sources 204 may be light emitting diodes, whereas in other examples, the light sources 204 may include any another appropriate source of light. Herein, the substrate 502 along with the light transmitting cover and the array of light sources 204 disposed on the substrate may be referred to as a 'light panel'. In one example, as illustrated in FIG. 5, the light panel may take the shape of a square in which case the light panel may be referred to as a light square. However, one of ordinary skill in the art can understand and appreciate that the light panel can take any appropriate shape, such as a light bar (rectangular shape) as illustrated in FIG. 2 without departing from a broader scope of this disclosure. Regardless of the shape of the light panel, the substrate 502 may include one or more coupling holes 504 for coupling the light shields 300 to the perimeter of substrate 502 as illustrated in FIG. 5. A light shield 300 may be coupled to the substrate 502 by placing the light shield 300 on the substrate 502 such that the aperture 320 of the first interlocking arm 314 and/or the aperture 322 of the second interlocking arm 316 is aligned with one or more coupling holes 504 of the substrate. Once the aperture 320 of the first interlocking arm 314 and/or the aperture 322 of the second interlocking arm 316 of the light shield 300 is aligned with one or more coupling holes 504 of the substrate 502, a fastener may be placed through the aligned aperture and the coupling hole to securely couple the light shield 300 to the substrate 502.

Further, as shown in FIG. 5, the first light shield 300*a* may be interlocked with the second light shield 300*b* by interlocking the first interlocking arm 314*a* of the first light shield 300*a* with the second interlocking arm 316*b* of the second light shield 300*b*. In particular, to interlock the first light shield 300*a* with the second light shield 300*b*, the recess 315 of the first interlocking arm 314*a* is mated with the second interlocking arm 316 of the second light shield 300*b* such that the aperture 320 of the first interlocking arm 314*a* is aligned with the aperture 322 of the second interlocking arm to receive a fastener therethrough. When the first light shield 300*a* is interlocked with the second light shield 300*b*, the overlap panels 310 and/or overlap surfaces (308, 309) of one light shield may be covered by at least a portion of the broad surfaces (302, 304) of the other interlocked light shield, as illustrated in FIG. 5. In particular, when the first light shield 300*a* is interlocked with the second light shield 300*b*, the first overlap surface 309 of the second light shield 300*b* may be covered and/or in contact with at least a portion of the second broad surface 304 of the first light shield 300*a*.

Further, the first light shield 300*a* that is interlocked with the second light shield 300*b* may be coupled to the substrate 502 by aligning the aperture 320 of the first interlocking arm 314*a* and the aperture 322 of the second interlocking arm (that are aligned through interlocking as described above) with the coupling hole 504 of the substrate and placing a fastener therethrough. The fastener as described herein may include any appropriate coupling member, such as a screw, bolt, etc. Although only two light shields 300*a* and 300*b* are shown in FIG. 5, one of ordinary skill in the art can understand and appreciate that more light shields can be used and coupled to the perimeter of the substrate 502 without departing from a broader scope of this disclosure. For example, in FIG. 5, in addition to the existing two light shields 300*a* and 300*b*, two more light shields may be interlocked and coupled to the perimeter of the substrate 502 to form an enclosed structure.

One of ordinary skill in the art can understand and appreciate that the broad surfaces (302, 304), the panels 399, the overlap surfaces (308, 309), the overlap panels 310, the base platform, the flange 312, the first interlocking arm 314, and the second interlocking arm 316 may all be integral to the shield body 301 and may be formed as a single light shield structure rather than individual components. In said embodiment, the broad surfaces (302, 304), the panels 399, the overlap surfaces (308, 309), the overlap panels 310, the base platform, the flange 312, the first interlocking arm 314, and the second interlocking arm 316 may be different portions of a single L-shaped light shield structure 300. In an alternative embodiment, each of the broad surfaces (302, 304), the panels 399, the overlap surfaces (308, 309), the overlap panels 310, the base platform, the flange 312, the first interlocking arm 314, and the second interlocking arm 316 may be formed separately and may be coupled to each other at installation to form the light shield 300.

Figure 6:
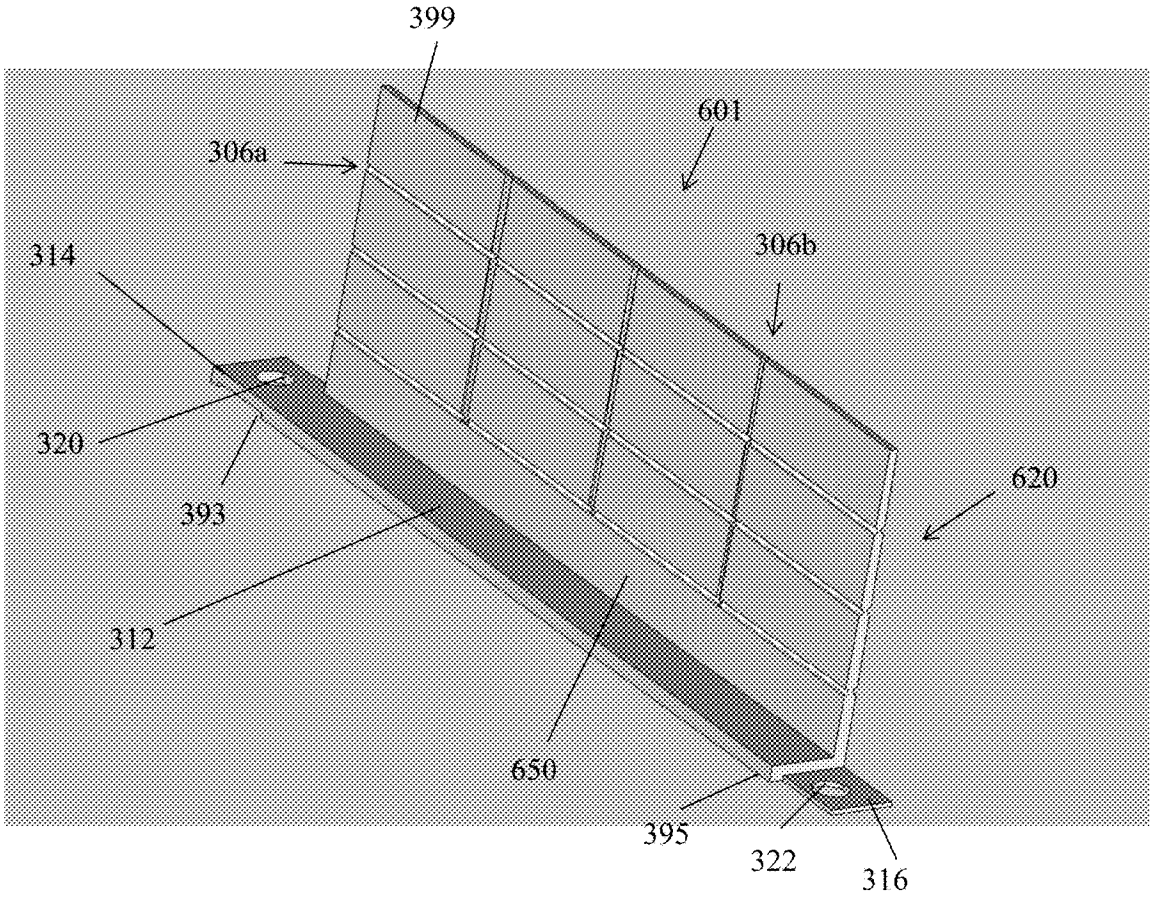
FIG. 6 illustrates a light shield absent the overlap portion, in accordance with example embodiments of the present disclosure.

Further, even though FIGS. 3-5 illustrate the shield body 301 of the light shield 300 as having a flat planar shape, one of ordinary skill in the art can understand and appreciate that the shield body 301 of the light shield 300 can have any other appropriate geometric or non-geometric shape without departing from a broader scope of the present disclosure. For example, the shield body 301 may be curved, wave shaped, or circular in shape (cylindrical light shield body). In some embodiments, the light shield body may be flexible. Furthermore, one of ordinary skill in the art can understand and appreciate that in some example embodiments, the light shield 300 may not include the overlap surfaces (308, 309) and/or the flange 312 along with the interlocking arms (314, 316). For example, FIG. 6 illustrates an embodiment of the light shield without the overlap portion (overlap surfaces 308,309). In an embodiment without the flange and interlocking arm, the light shield 300 may be mounted on the substrate 502 or luminaire using any other appropriate coupling and/or mounting mechanisms without departing from a broader scope of the present disclosure.

Turning to FIG. 6, this figure illustrates a light shield absent the overlap portion/overlap surfaces, in accordance with example embodiments of the present disclosure. In particular, FIG. 6 illustrates a light shield having a light shield body 601 which is substantially similar to the light shield body 301 illustrated in FIG. 3 except for the absence of an overlap portion having overlap surfaces (308, 308) and a corresponding base platform 352 associated with the overlap surfaces (308, 309). The light shield body 601 of FIG. 6 includes a detachable panel area 620 (also interchangeably referred to as 'scored area, score line area, or broad surface having score lines' throughout this disclosure) having one or more score lines 306*a*, 306*b* that define one or detachable panels 399. Further, the light shield body 601 includes a base platform 650 positioned below the detachable panel area 620. The base platform 650 may or may not include score lines. Furthermore, the light shield body 601 may include a flange 312 that extends from a bottom portion of the base platform 650. In particular, the flange 312 may extend substantially perpendicular to the base platform 652 and the detachable panel area 620. The flange 312 may include two interlocking arms 314 and 316 extending from lateral ends 393 and 395 of the flange 312, respectively. The flange 312 and the two interlocking arms 314, 316 have been described above in association with FIG. 3. Accordingly, their description will not be repeated herein for sake of brevity. Further, the panels 399 may be detachable along the edges or from the center as desired and as described above in association with FIGS. 3 and 4.

One of ordinary skill in the art can understand and appreciate that even though the detachable panels are illustrated as rectangular panels, in other embodiments, the detachable panel may have any other appropriate geometric or non-geometric shape without departing from a broader scope of the present disclosure.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A light shield, comprising:

a first broad surface having a first plurality of score lines;

a second broad surface opposite to the first broad surface and having a second plurality of score lines, wherein the first plurality of score lines and the second plurality of score lines are aligned with each other and define one or more detachable panels;

a flange that extends substantially perpendicular to and along a length of a base platform of the light shield, wherein the base platform is located adjacent the first and second broad surfaces;

a first interlocking arm extending from a first end of the flange; and a second interlocking arm extending from a second end of the flange that is opposite to the first end of the flange.

2. The light shield of claim 1, further comprising:

a first overlap surface having a third plurality of score lines; and a second overlap surface opposite to the first overlap surface and having a fourth plurality of score lines, wherein the first overlap surface and the second overlap surface extend from a lateral end of the first broad surface and a lateral end of the second broad surface.

3. The light shield of claim 2, wherein the first overlap surface and the second overlap surface extend substantially perpendicular to the first broad surface and the second broad surface.

4. The light shield of claim 2, wherein the first overlap surface and the second overlap surface extend at an angle other than 90 degrees to the first broad surface and the second broad surface.

5. The light shield of claim 2, wherein the third plurality of score lines and the fourth plurality of score lines are aligned with each other and define one or more detachable overlap panels.

6. The light shield of claim 1, wherein each of the one or more detachable panels is detachable along its respective score lines to control a light distribution from a luminaire.

7. The light shield of claim 1, wherein the first interlocking arm and the second interlocking arm are adapted to interlock the light shield with one or more other light shields; and wherein each of the first interlocking arm and the second interlocking arm include an aperture.

8. The light shield of claim 1:

wherein the first interlocking arm is flush with a top surface of the flange and has a recess that is adapted to mate with a second interlocking arm of a second light shield to interlock the light shield to the second light shield, and wherein when the first interlocking arm of the light shield is interlocked with the second interlocking arm of the second light shield, an aperture of the first interlocking arm of the light shield is aligned with an aperture of the second interlocking arm of the second light shield.

9. The light shield of claim 1:

wherein the second interlocking arm is flush with a bottom surface of the flange and is offset from a top surface of the flange, wherein the second interlocking arm is adapted to mate with a first interlocking arm of a second light shield to interlock the light shield with the second light shield, and wherein when the second interlocking arm of the light shield is interlocked with the first interlocking arm of the second light shield, the aperture of the second interlocking arm of the light shield is aligned with an aperture of the first interlocking arm of the second light shield.

10. A light shield, comprising:

a main portion comprising a first scored area comprising a plurality of score lines that define one or more detachable panels;

an overlap portion that is substantially perpendicular to and extends away from an edge of the main portion, wherein the overlap portion comprises a second scored area comprising another plurality of score lines that define one or more detachable overlap panels; and a flange disposed adjacent an end of the light shield and extending substantially perpendicular to and along a length of the main portion, wherein the flange comprises:

a first interlocking arm extending beyond the length of main portion from a first end of the flange; and a second interlocking arm extending beyond the length of the main portion from a second end of the flange that is opposite to the first end of the flange, wherein the second interlocking arm extends in a direction opposite to the direction of the first interlocking arm.

11. The light shield of claim 10, wherein the main portion further comprises a base platform disposed between the end of the light shield and the first scored area, wherein the overlap portion further comprises a base platform disposed between the end of the light shield and the second scored area, and wherein the main portion base platform and the overlap portion base platform are substantially perpendicular to each other.

12. The light shield of claim 10, wherein the overlap portion is at an angle other than 90 degrees to the main portion.

13. The light shield of claim 10, wherein each of the one or more detachable panels is detachable along its respective score lines to control a light distribution from a luminaire.

14. The light shield of claim 10:

wherein the first interlocking arm and the second interlocking arm are adapted to interlock the light shield with one or more other light shields, and wherein each of the first interlocking arm and the second interlocking arm include an aperture, wherein the first interlocking arm is flush with a top surface of the flange and has a recess that is adapted to mate with a second interlocking arm of a second light shield to interlock the light shield to the second light shield, and wherein when the first interlocking arm of the light shield is interlocked with the second interlocking arm of the second light shield, the aperture of the first interlocking arm of the light shield is aligned with an aperture of the second interlocking arm of the second light shield.

15. A light shield comprising:

a light shield body that comprises:

a detachable panel area having one or more detachable panels;

a base platform disposed adjacent to the detachable panel area;

a flange extending from the base platform at an angle with respect to the base platform and the detachable panel area of the light shield body;

a first interlocking arm extending from a first lateral end of the flange in a first direction of a longitudinal length of the flange; and a second interlocking arm extending from a second lateral end of the flange that is opposite to the first end of the flange in a second direction of the longitudinal length of the flange, wherein the first direction and the second direction are opposite to each other, wherein the first interlocking arm is flush with a top surface of the flange and has a recess that is adapted to mate with a second interlocking arm of a second light shield to interlock the light shield to the second light shield, and wherein the second interlocking arm is flush with a bottom surface of the flange and is offset from the top surface of the flange.

16. The light shield of claim 15, wherein the first interlocking arm and the second interlocking arm are adapted to interlock the light shield with one or more other light shields including the second light shield.

17. The light shield of claim 15, wherein each of the first interlocking arm and the second interlocking arm include an aperture.

18. The light shield of claim 15, wherein each of the one or more detachable panels is defined by one or more score lines, and wherein each of the one or more detachable panels is detachable along the score lines.

* * * * *